US007244375B2

(12) United States Patent
Drachev et al.

(10) Patent No.: US 7,244,375 B2
(45) Date of Patent: Jul. 17, 2007

(54) THERMOSTABLE ELECTROCONDUCTIVE POLYMER LAYER AND METHOD OF PREPARING THE SAME

(75) Inventors: Alexandr Ivanovich Drachev, Moscow (RU); Alla Borisovna Gilman, Moscow (RU); Alexandr Alexeevich Kuznetsov, Moscow (RU)

(73) Assignees: Samsung Electronics Co., Ltd., Suwon-Si, Gyeonggi-do (KR); N S Enikolopov Institute of Synthetic Polymer Materials, Russian Academy of Sciences, Moscow (RU)

( * ) Notice: Subject to any disclaimer, the term of this patent is extended or adjusted under 35 U.S.C. 154(b) by 415 days.

(21) Appl. No.: 10/990,519

(22) Filed: Nov. 18, 2004

(65) Prior Publication Data

US 2005/0133765 A1 Jun. 23, 2005

(30) Foreign Application Priority Data

Nov. 21, 2003 (RU) ..... 2003-133970

(51) Int. Cl.
*H01B 1/12* (2006.01)

(52) U.S. Cl. ..... 252/500; 552/238; 528/483

(58) Field of Classification Search ..... 252/500; 552/238, 249; 528/483, 490
See application file for complete search history.

(56) References Cited

U.S. PATENT DOCUMENTS 4,505,846 A * 3/1985 House et al. ..... 252/500
5,030,387 A * 7/1991 Matsuoka et al. ..... 252/582

FOREIGN PATENT DOCUMENTS

| | | |
|---|---|---|
| DE | 3541721 C2 | 11/1990 |
| DE | 4207422 | 9/1993 |
| JP | 1991-239721 | 10/1991 |
| RU | 2205838 C1 | 10/2003 |

OTHER PUBLICATIONS

Ismail et al "Electrochemical preparation and characterization of poly(1-amino-9,10-anthraquinone) films", Electrochimica Acta 47 (2002) 1867-73. May 2002.*
Tanaka et al., Plasma polymerization of 1-benzothiophene, 70(10) J. Appl. Phys. 5653-5660 (1991).
Stejskal et al., Polyaniline and Polypyrrole prepared in the presence of surfactants: a comparative conductivity study, 44(5) Polymer, 1353-1358 (2003).
Lodha et al., Effect of Annealing on Electrical Conductivity and Morphology of Polyaniline films, 82(14) J. Appl. Polym. Sci., 3602-3610 (2001).

(Continued)

*Primary Examiner*—Mark Kopec

(57) ABSTRACT

The present invention is related to a thermostable electroconductive polymer layer comprising an iodine-doped polymer layer based on 1-amino-9,10-anthraquinone having an electrical conductivity in the range of about $10^{-2}$ Sm/cm to about $10^{2}$ Sm/cm. Additionally, the present invention is related to methods for preparing the thermostable electroconductive polymer layer. The method comprises polymerizing 1-amino-9,10-anthraquinone vapors at a reduced pressure in a direct current discharge on a cathode at a temperature in the range of about 150° C. to about 300° C., providing the necessary vapor pressure for a time period in the range of about 5 minutes to about 30 minutes and doping the prepared layer with iodine vapors.

10 Claims, 1 Drawing Sheet

OTHER PUBLICATIONS

Jousseaume et al., Thermal Behavior of Polyaniline Films and Polyaniline-Polystyrene Blends, 84(10) J. Appl. Polym. Sci., 1848-1855 (2002).
Jousseaume et al., XPS Study of Aged Polyaniline Films, 90(13) J. Appl. Polym. Sci., 3730-3736 (2003).
Morales et al., Plasma Polymerization of Random Polyaniline-Polypyrrole-Iodine Copolymers, 85(2) J. Appl. Polym. Sci., 263-270 (2002).
Tanaka et al., Plasma Polymerization of Thiophene and 3-Methylthiophene, 38 Synthetic Metals, 107-116 (1990).

* cited by examiner

THERMOSTABLE ELECTROCONDUCTIVE POLYMER LAYER AND METHOD OF PREPARING THE SAME

CROSS-REFERENCE OF RELATED APPLICATIONS

The present application claims priority to Russian Patent Application No. 2003133970, filed on Nov. 21, 2003, the disclosure of which is hereby incorporated herein by reference in its entirety.

FIELD OF THE INVENTION

The present invention is related to a thermostable electroconductive polymer layer and methods for preparing the same. More particularly, the present invention is related to electroconductive polymer layers, such as films and coatings, that may be prepared by a method of polymerization in an electrical discharge.

BACKGROUND

Polymer films having an electrical conductivity suitable for semiconductors may be formed from thiophene, 3-methylthiophene, 1-benzthiophene, aniline, and pyridine. Thin films of polymers prepared from thiophene and 3-methylthiophene in a high frequency (HF) discharge (13.56 MHz) have a semiconductor nature ($\sigma$ about $10^{-7}$ to $10^{-10}$ Sm/cm) Semiconducting polymer films arranged on substrates made of quartz, glass or aluminum are obtained from halogen-substituted five-membered heterocyclic compounds, for example, 3-bromothiophene, and 2,2'-dibromothiophene as disclosed in Japan Patent No. 3-239721 A, published 1991. Polymer films having high electrical conductivity, however, cannot be obtained by these methods.

Thin polymer layers having higher electrical conductivity in the range of about $4\times10^{-5}$ Sm/cm to about $10^{-1}$ Sm/cm and a method of preparing the thin polymer layers are disclosed in patent DE 4207422. The method consists of polymerizing compounds in a microwave discharge reactor. The compounds have a doping means chemically bound to the compound, for example, 2-iodothiophene, iodomethane or iodobenzene. The process is carried out under the discharge of a frequency from 0.1 GHz to 1000 GHz at a temperature of not more than 100° C. and pressure of from $10^{-3}$ mm to 10 mm Hg in the presence of a gas-carrier. Accordingly, the electrical conductivity of the polymer layers is increased by the use of compounds comprising doping agents bonded to the polymer.

Disadvantages of producing polymer layers by the above-described methodology include difficulty in controlling the complicated process which is based on several chemical reactions. For example, the conversion depends upon the properties of the layers to be formed and the corrosion activity of the initial iodine-containing substances in respect to the sophisticated reaction equipment.

Stability data of the electrical conductivity properties after heating are known only for semiconducting polymers prepared by chemical methods in a solution in the presence of doping agents other than iodine. For example, polymers of aniline and pyrrole are synthesized by oxidative chemical polymerization in the presence of anionic surfactants, such as sodium bis-2-ethylhexlyl sulfosuccinate, dodecylbenzenesulfonic acid, sodium salt of the acid or sodium dodecylsulfate. After heating to 175° C. and subsequent cooling to 20° C., with respect to polyaniline the electrical conductivity decreases by 2 to 3 orders of magnitude, and with respect to polypyrrole the electrical conductivity decreases by 4 to 7 orders of magnitude. An irreversible reduction of electrical conductivity after heating to 180° C. and subsequent cooling to 20° C. is also observed with respect to polyaniline films synthesized by an electrochemical method and doped with HCI or air moisture (measurements were carried out at a humidity in the range of about 10 to about 100%).

Semiconducting polymer films and methods for producing the films comprising the polymerization of mixtures of aniline and pyrrole with the addition of iodine in a high-frequency discharge (13.56 MHz) are also known. The electrical conductivity of the resultant films is in the range of about $10^{-9}$ Sm/cm to $10^{-8}$ Sm/cm, and changes depending on the air humidity when ranging from about 10% to about 70% humidity. When the air humidity increases to 92%, the electrical conductivity increases to $10^{-3}$ Sm/cm. When heated to 250° C., a film prepared from a mixture of aniline and pyrrole without the addition of iodine loses 15% of its weight, and a film prepared from the mixture with the addition of iodine loses 30% of its weight. The lower thermal stability of the iodine-containing copolymer may occur because iodine atoms more easily evaporate. These polymer films have several disadvantages such as low electrical conductivity at low air humidity and the dependence of electrical conductivity on humidity.

An increase in electrical conductivity of the films obtained by polymerization in a HF discharge at the same frequency (13.56 MHz) may be achieved by using monomers that are capable of forming polymers having a high content of conjugated double bonds. For example, unsaturated aliphatic or alicyclic compounds, such as acrylonitrile, 2-chloroacrylonitrile, 1,4-diazine, in the presence of a doping agent, such as iodine are disclosed in DE 3541721. The substrate temperature during polymerization may be in the range of about 15° C. to 250° C. The stability of electroconductive properties of the polymer films after heating may be presumed to be the same as for a polymer made from acrylonitrile, where the maximum temperature of stability of the electroconductive properties is not more than 200° C., since the polymer is destroyed between 220° C. to about 230° C. There are several disadvantages associated with these films such as insufficient electrical conductivity of the films (not more than $10^{-1}$ Sm/cm). Additionally, the presence of iodine vapors in the reaction chamber, which have a high corrosive activity, may cause damage to the sophisticated reaction apparatus. Furthermore, additional steps are required which involve a special gaseous catcher for radicals or halogen-containing hydrocarbons.

Electroconductive polymer layers such as films and coatings, prepared under conditions of a HF discharge do not exhibit a sufficient level of electrical conductivity and are significantly reduced after heating. This may be due to the participation of several different types of active particles in the process of polymerization with high frequency (HF) and ultrahigh frequency (UHF) discharges. Under such conditions, it is difficult to ensure the preparation of a layer structure, including the case of doped layers that is capable of obtaining high electrical conductivity and is stable after heating.

Additionally, electroconductive polymer layers and methods for preparing the layers where polymerization is carried out in a direct current discharge below atmospheric pressure and where the layers are formed on the cathode are disclosed in Russian patent No. RU 2205838. Here, the monomer may comprise organic compounds, for example, hydroxyl and/or amino-substituted aromatic quinones comprising at least two condensed cores, such as, 1-amino-9,10-anthraquinone. Polymer layers produced by this methodology have a sufficiently high electrical conductivity of about $10^{-2}$ Sm/cm. However, the resultant layers are limited by the specific temperature, specific time constraints and specific discharge current value required to perform the methodology.

Films having semiconductor properties and a method for their preparation by the polymerization of 1-benzthiophene with HF discharges (between a frequency of 10 kHz and 13.56 MHz) where the initial substance is evaporated by heating to 60° C. in the presence of a gas-carrier of argon or nitrogen and then doping with iodine is also known. The electrical conductivity of these films is in the range of about $10^{-4}$ Sm/cm to $10^{-5}$ Sm/cm. The major disadvantage associated with these films is their low electrical conductivity. Additionally, the methodology is very expensive due to the need to use an inert gas-carrier of oxygen or purified nitrogen.

SUMMARY OF THE INVENTION

The present invention is directed to a thermostable electroconductive polymer layer having a high electrical conductivity which is not reduced to a significant degree following heating. Additionally, the present invention is also directed to methods for preparing the polymer layer, which are capable of achieving enhanced electroconductive properties as well as retaining stability of the electroconductive properties after heating. The methods of the present invention may also be expanded to fabricate a variety of layers.

DETAILED DESCRIPTION OF THE INVENTION

Figure 1:
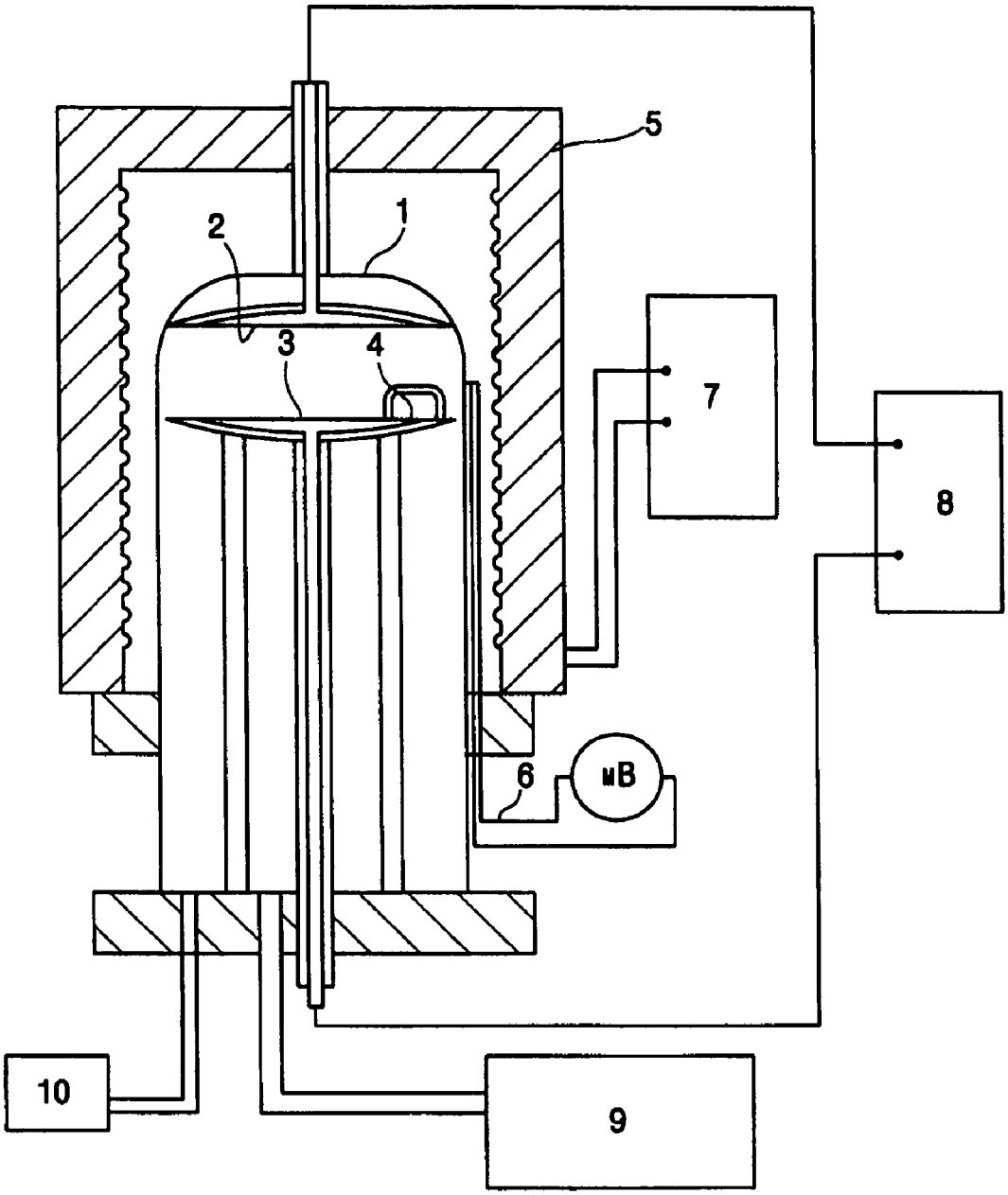
FIG. 1, which illustrates an embodiment of the present invention, depicts a scheme of a vacuum reaction set-up for carrying out the method of preparing the polymer layer of the present invention. The following numeral references are used: 1—a chamber, 2—a cathode, 3—an anode, 4—a cup containing an initial substance, 5—an electric furnace, 6—a Chromel-Copel thermocouple, 7—a power supply unit for the electric furnace, 8—a source of direct current, 9—an evacuation system, and 10—a pressure measuring system.

An embodiment of the present invention contemplates a thermostable electroconductive polymer layer, such as a film or coating, comprising an iodine-doped polymer layer based on 1-amino-9,10-anthraquinone. The polymer layer may be characterized having an electrical conductivity in the range of about $10^{-2}$ Sm/cm to about $10^{2}$ Sm/cm (or $Ohm^{-1}$ $cm^{-1}$), which is retained after heating. In particular, a reduction of the electrical conductivity of the polymer layers of the present invention is not more than about 10% after heating in air to about 280° C. followed by cooling to about 20° C.

In an additional embodiment, the polymer layer of the present invention maybe characterized by increased electrical conductivity with simultaneous retention of electrical conductivity after heating. Specifically, the reduction in electrical conductivity following heating is less than about 10%. The presence of iodine in the polymer layer composition does not result in a reduction of the high electrical conductivity during heating.

In another embodiment, methods of preparing a thermostable electroconductive polymer layer, such as a film or coating, comprising an iodine-doped polymer layer based on 1-amino-9,10-anthraquinone and having an electrical conductivity in the range of about $10^{-2}$ S/cm to about $10^{2}$ Sm/cm are provided. The method may comprise the polymerization of 1-amino-9,10-anthraquinone vapors under a reduced pressure. The polymerization may occur on a cathode under a direct current discharge. The polymerization may occur at a temperature which provides adequate vapor pressure for a time period sufficient to obtain a predetermined thickness of the layer with any combinations of the polymerization process parameters. Then, the resultant layer may be doped with iodine vapors. In particular, the polymerization may be carried out at a temperature in the range of about 150° C. to about 300° C., using a discharge current in the range of about 5 mA to about 100 mA. In particular, the discharge current is in the range of about 15 mA to about 30 mA, for a time period in the range of about 5 minutes to 30 minutes. Additionally, the doping may be carried out at a temperature in the range of about 20° C. to about 150° C.

In further embodiments, 1-amino-9,10-anthraquinone may be used as the initial compound, and the polymerization may be carried out on the cathode in the direct current discharge. The process parameters in combination with the chemical structure of the initial compound may result in enhanced electrical conductivity of the polymer layer. Surprisingly, doping with iodine does not result in a reduction of the attained level of electrical conductivity after heating. The present invention may be used in any application that may require thermostable electroconductive polymer layers that maintain their functional properties at elevated temperatures, such as in electrical engineering, electronics, and optoelectronics, for example.

According to an embodiment, a separation of active charged particles participating in the polymerization may occur in the direct current discharge under the above-described conditions which may result in minimization of by-processes which limit the growth of a conjugation chain in the polymer being formed. Furthermore, a compound comprising three condensed aromatic rings may be used as the initial compound, whereby the formation of an expanded (lengthy) conjugation system may be promoted in the polymer. The subsequent doping of the polymer layer may result in an increase of the electrical conductivity. An unexpected effect is the stability of the electrical conductivity after heating, which may be due to the high bonding strength of the polymer-iodine bond.

EXAMPLES

The present invention may be illustrated by the following examples.

Specific Example 1:

Referring to FIG. 1, in the reaction reaction chamber 1 having a horizontally positioned cathode 2 and an anode 3, a ceramic cup 4 containing an initial substance of 1-amino-9,10-anthraquinone (AAQ) was placed on the anode. An upper part of the chamber was placed in an electric furnace 5 which heated the chamber to a temperature in the range of about 20° C. to about 400° C. The temperature was controlled using a Chromel-Copel thermocouple 6. In order to carry out the process of preparing a polymer layer, the reaction chamber was initially evacuated to a pressure of about $10^{-1}$ Pa, then was heated to about 250° C. and a discharge voltage 8 was applied to the electrodes 2 and 3. Polymerization was carried out at a temperature of about 250° C., a discharge current of about 25 mA, for a time period of about 15 minutes. The layer was removed from the reaction chamber and was doped in an atmosphere of saturated iodine vapors at a temperature of about 50° C. for about 120 minutes. The prepared layer had an electrical conductivity of about $2.3\times10^{1}$ Sm/cm and after heating to a temperature of about 280° C. and subsequent cooling to about 20° C., the conductivity was about $2.2\times10^{1}$ Sm/cm.

Specific Example 2:

Referring to FIG. 1, in the reaction reaction chamber 1 having a horizontally positioned cathode 2 and an anode 3, a ceramic cup 4 containing an initial substance of 1-amino-9,10-anthraquinone (AAQ) was placed on the anode. An upper part of the chamber was placed in an electric furnace 5. The temperature was controlled using a Chromel-Copel thermocouple 6. In order to carry out the process of preparing a polymer layer, the reaction chamber was initially evacuated to a pressure of about $10^{-1}$ Pa, then was heated to about 250° C. and a discharge voltage 8 was applied to the electrodes 2 and 3. Polymerization was carried out at a temperature of about 150° C., a discharge current of about 15 mA, for a time period of about 30 minutes. The layer was removed from the reaction chamber and was doped in an atmosphere of saturated iodine vapors at a temperature of about 20° C. for about 120 minutes. The prepared layer had an electrical conductivity of about $1\times10^{-2}$ Sm/cm and after heating to a temperature of about 280° C. and subsequent cooling to about 20° C., the conductivity was about $1\times10^{-2}$ Sm/cm.

Specific Example 3:

Referring to FIG. 1, in the reaction reaction chamber 1 having a horizontally positioned cathode 2 and an anode 3, a ceramic cup 4 containing an initial substance of 1-amino-9,10-anthraquinone (AAQ) was placed on the anode. An upper part of the chamber was placed in an electric furnace 5. The temperature was controlled using a Chromel-Copel thermocouple 6. In order to carry out the process of preparing a polymer layer, the reaction chamber was initially evacuated to a pressure of about $10^{-1}$ Pa, then was heated to about 250° C. and a discharge voltage 8 was applied to the electrodes 2 and 3. Polymerization was carried out at a temperature of about 350° C., a discharge current of about 30 mA, for a time period of about 15 minutes. The layer was removed from the reaction chamber and was doped in an atmosphere of saturated iodine vapors at a temperature of about 150° C. to about 20 minutes. The prepared layer had an electrical conductivity of about $1\times10^{2}$ Sm/cm and after heating to a temperature of about 280° C. and subsequent cooling to about 20° C., the conductivity was about $1\times10^{2}$ Sm/cm.

Specific Example 4:

Referring to FIG. 1, in the reaction reaction chamber 1 having a horizontally positioned cathode 2 and an anode 3, a ceramic cup 4 containing an initial substance of 1-amino-9,10-anthraquinone (AAQ) was placed on the anode. An upper part of the chamber was placed in an electric furnace 5. The temperature was controlled using a Chromel-Copel thermocouple 6. In order to carry out the process of preparing a polymer layer, the reaction chamber was initially evacuated to a pressure of about $10^{-1}$ Pa, then was heated to about 250° C. and a discharge voltage 8 was applied to the electrodes 2 and 3. Polymerization was carried out at a temperature of about 250° C., a discharge current of about 20 mA, for a time period of about 5 minutes. The layer was removed from the reaction chamber and was doped in an atmosphere of saturated iodine vapors at a temperature of about 50° C. for about 30 minutes. The prepared layer had an electrical conductivity of about $5.1\times10^{1}$ Sm/cm and, after heating to a temperature of about 280° C. and subsequent cooling to about 20° C., the conductivity was about $5.0\times10^{1}$ Sm/cm.

Specific Example 5:

Referring to FIG. 1, in the reaction reaction chamber 1 having a horizontally positioned cathode 2 and an anode 3, a ceramic cup 4 containing an initial substance of 1-amino-9,10-anthraquinone (AAQ) was placed on the anode. An upper part of the chamber was placed in an electric furnace 5. The temperature was controlled using a Chromel-Copel thermocouple 6. In order to carry out the process of preparing a polymer layer, the reaction chamber was initially evacuated to a pressure of about $10^{-1}$ Pa, then was heated to about 250° C. and a discharge voltage 8 was applied to the electrodes 2 and 3. Polymerization was carried out at a temperature of about 300° C., a discharge current of about 15 mA, for a time period of about 20 minutes. The layer was removed from the reaction chamber and was doped in an atmosphere of saturated iodine vapors at a temperature of about 100° C. for about 20 minutes. The prepared layer had an electrical conductivity of about $4.7\times10^{1}$ Sm/cm and after heating to a temperature of about 280° C. and subsequent cooling to about 20° C., the conductivity was about $4.7\times10^{1}$ Sm/cm.

The conditions for carrying out the process and the electrical conductivity of the obtained polymer layers before and after heating to about 280° C. followed by cooling to about 20° C. are presented in the Table 1.

TABLE 1

| | Parameters for preparation of polymer layers | | | | | Electrical conductivity, Sm/cm | | |
|---|---|---|---|---|---|---|---|---|
| | Polymerization conditions in DC discharge | | | Conditions for doping layers | | | After heating to 28 0° C. and | Conductivity |
| Example No. | Temperature, (° C.) | Current, (ma) | Time, (minutes) | Temperature, (° C.) | Time, (minutes) | After doping | cooling to 20° C. | reduction, % |
| 1 | 250 | 25 | 15 | 50 | 120 | $2.3\times10^{1}$ | $2.2\times10^{1}$ | 4.4 |
| 2 | 150 | 15 | 30 | 20 | 120 | $1\times10^{-1}$ | $1\times10^{-2}$ | — |
| 3 | 350 | 30 | 15 | 150 | 20 | $1\times10^{2}$ | $1\times10^{2}$ | — |

TABLE 1-continued

| | Parameters for preparation of polymer layers | | | | | Electrical conductivity, Sm/cm | | |
|---|---|---|---|---|---|---|---|---|
| | Polymerization conditions in DC discharge | | | Conditions for doping layers | | | After heating to 28 0° C. and | Conductivity |
| Example No. | Temperature, (° C.) | Current, (ma) | Time, (minutes) | Temperature, (° C.) | Time, (minutes) | After doping | cooling to 20° C. | reduction, % |
| 4 | 250 | 20 | 5 | 50 | 30 | $5.1 \times 10^1$ | $5.0 \times 10^1$ | 2.0 |
| 5 | 300 | 15 | 20 | 100 | 20 | $4.7 \times 10^1$ | $4.7 \times 10^1$ | — |
| According to known method method | up to 250 | *HF-discharge up to 50 W | up to 300 | up to 250 | During discharge up to 5 hours | not more than $10^{-1}$ | no data | no data |
| According to closest prior art method | 60 | *HF-discharge, 15–80 W | 40 | — | >5 hours | $10^{-4}$ to $10^{-5}$ | no data | no data |
| Comparative example according to RU 2205838 | 240 | 15 | 120 | No doping | | Without doping $2 \times 10^{-2}$ | no data | no data |

As shown in Table 1, the thermostable electroconductive polymer layers obtained in accordance with the present invention have high electrical conductivity which, in the majority of cases, exceeds the electrical conductivity of the known layers and as distinctive from the prior art, the doping with iodine does not result in a reduction of the electrical conductivity after heating.

What is claimed is:

1. A thermostable electroconductive polymer layer comprising an iodine-doped polymer layer based on 1-amino-9, 10-anthraquinone, wherein the thermostable electroconductive polymer layer has an electrical conductivity in a range of about $10^{-2}$ Sm/cm to about $10^2$ Sm/cm.

2. The thermostable electroconductive polymer layer of claim 1, wherein after heating to about 280° C. followed by cooling to about 20° C. the electrical conductivity of the electroconductive polymer is not greater than about 10%,.

3. A method of preparing a thermostable electroconductive polymer layer comprising:

polymerizing 1-amino-9,10-anthraquinone vapors in a direct current discharge on a cathode to form a polymer layer; and doping the polymer layer with iodine vapors.

4. The method of claim 3, wherein the vapor is polymerized at a temperature in the range of about 150° C. to about 300° C.

5. The method of claim 3, wherein the direct current discharge applied to the cathode is in a range of about 5 mA to about 100 mA.

6. The method of claim 5, wherein the direct current discharge applied to the cathode is in a range of about 15 mA to about 30 mA.

7. The method of claim 3, wherein the vapor is polymerized for a time period in the range of about 5 minutes to about 30 minutes.

8. The method according to claim 3, wherein the polymer layer is doped at a temperature in the range of about 20° C. to about 150° C.

9. The method according to claim 8, wherein the polymer layer is doped for a time period in the range of about 20 minutes to about 120 minutes.

10. The method according to claim 9, wherein the polymer layer is doped for a time period in the range of about 20 minutes to about 30 minutes.

* * * * *